US006433324B1

(12) United States Patent
Kim

(10) Patent No.: US 6,433,324 B1
(45) Date of Patent: Aug. 13, 2002

(54) HOOD APPARATUS OF VENTILATION HOODED MICROWAVE OVEN

(75) Inventor: Su-Hwan Kim, Changwon Gyeongman (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/902,739

(22) Filed: Jul. 12, 2001

(30) Foreign Application Priority Data

Nov. 1, 2000 (KR) ..... 00-30555

(51) Int. Cl.[7] ..... H05B 6/80
(52) U.S. Cl. ..... 219/757; 126/21 A; 126/299 D
(58) Field of Search ..... 219/757, 681, 219/756, 400; 126/21 A, 299 R, 299 D, 273 R, 275 E

(56) References Cited

U.S. PATENT DOCUMENTS 4,327,274 A * 4/1982 White et al. ..... 219/757
4,418,261 A * 11/1983 Jailor et al. ..... 219/757
5,042,458 A * 8/1991 Spencer et al. ..... 126/299 R
5,866,886 A * 2/1999 Lange et al. ..... 219/757

* cited by examiner

*Primary Examiner*—Philip H. Leung
(74) *Attorney, Agent, or Firm*—Fleshner & Kim, LLP

(57) ABSTRACT

A hood apparatus for a ventilation-hooded microwave oven configured to prevent contamination of electric equipment within an electrical equipment installation chamber. An exhaust flow passage for discharging contaminated air generated from an oven range, which is installed below the ventilation-hooded microwave oven, is formed such that the contaminated air does not pass by the electric equipment installed in the electric equipment installation chamber. Further, a bottom plate is installed on a bottom surface of the electric equipment installation chamber in order to prevent the chamber from communicating with the exhaust airflow passage. Furthermore, contaminated air sucked from outside of the ventilation-hooded microwave oven flows only through a gap between an outer case and a cavity and then toward an exhaust motor. Since the exhaust airflow passage for performing a hood function is not formed within the electric equipment installation chamber, contamination of the electric equipment in the chamber can be prevented. Further, since the volume of the electric equipment installation chamber is minimized, the ventilation-hooded microwave can be miniaturized.

11 Claims, 3 Drawing Sheets

HOOD APPARATUS OF VENTILATION HOODED MICROWAVE OVEN

FIELD OF INVENTION

The present invention relates to a microwave oven, and more particularly, to an exhaust airflow passage structure of a ventilation-hooded microwave oven for discharging a hot air stream generated from an oven range that is installed below the microwave oven.

BACKGROUND OF INVENTION

In general, a ventilation-hooded microwave oven is installed above an oven range and has an exhausting function for discharging hot air, smoke, etc. generated from the oven range in addition to a cooking function, i.e., an original function of a microwave oven.

Referring first to FIGS. 1 to 3, a conventional exhaust airflow passage structure of the ventilation-hooded microwave oven will be explained. FIG. 1 shows a general arrangement of the oven range and the ventilation-hooded microwave oven. That is, hot air, smoke, etc., which are generated from the oven range 2 during its use, flow toward the ventilation-hooded microwave oven 4 (so-called OTR (Over The Range), hereinafter referred to as "microwave oven") installed above the oven range, and are discharged upward through the exhaust airflow passage of the microwave oven 4.

FIG. 2 is a front sectional view showing a structure of the exhaust airflow passage, and FIG. 3 is a right-side sectional view showing the exhaust airflow passage. As shown in FIGS. 2 and 3, a cavity 14 in which foodstuffs are cooked is provided within an outer case 12 for defining an external appearance of the microwave oven. A predetermined space for forming a passage through which air flows is provided between a left side 14*a* of the cavity 14 (with respect to the direction of the figures) and the outer case 12.

A base plate 16 defines a lower surface of the microwave oven 4, i.e., a surface opposite to the oven range 2, and a suction portion 16*a* for sucking up the hot air and the smoke generated from the oven range 2 is also formed in the base plate 16.

Beside the cavity 14 is provided an electric equipment installation chamber 20 in which several electric equipments for generating microwave to be introduced into the cavity 14 are installed. A bottom plate 18 is formed on a bottom surface of the electric equipment installation chamber 20, and a passage hole 22, through which air flows via the electric equipment installation chamber 20, is formed in the bottom plate 18. Further, an exhaust motor 24 for providing driving force for discharging the hot air and the smoke generated from the oven range 2 is installed on a rear and upper portion of the cavity 14. The exhaust motor 24 is connected to an additional exhaust duct and is communicated with a front or rear exhaust grille of the microwave oven 4. Thus, the hot air and the smoke can be discharged therethrough.

In the prior art constructed as such, the exhaust motor 24 is operated so as to discharge the hot air or smoke generated from the oven range 2. The hot air and the smoke are sucked through the suction portion 16*a* of the base plate 16 by means of suction force of the exhaust motor 24, and then they flow and are discharged in the direction of arrows shown in FIGS. 2 and 3.

That is, the hot air and the smoke passing through the base plate 16 are divided into two air streams with respect to the cavity 14. Then, one of the two streams flows between the outer case 12 and the left side of the cavity 14 and toward the exhaust motor 24 located above the cavity 14, while the other stream flows toward the exhaust motor 24 through the passage hole 22 perforated in the bottom plate 18 and via the electric equipment installation chamber 20.

However, there are the following problems in the conventional exhaust airflow structure that works as described above.

That is, in the electric equipment installation chamber 20 are provided major electric equipments including a magnetron as a part for oscillating microwave in order to heat and cook the foodstuffs in the cavity 14, a high-voltage transformer for applying high voltage to the magnetron, etc. Moreover, since the contaminated air, which is generated when the foodstuffs are cooked in the oven range, is sucked through the suction portion 16*a* of the base plate 16 of the microwave oven 4, the magnetron and the high-voltage transformer are contaminated by the air passing through the electric equipment installation chamber 20. As a result, there are problems in that the operation reliability of the magnetron, the transformer, etc. is lowered and the performance of the microwave oven is deteriorated.

Furthermore, if the airflow passage for a hood function is formed in the electric equipment installation chamber 20 similarly to the prior art, the volume of the electric equipment installation chamber 20 is increased in proportion to that of the passage. Thus, there is also a problem in that the size of the microwave oven as a whole is increased.

SUMMARY OF INVENTION

It is an object of the present invention to prevent electric equipments installed within an electric equipment installation chamber from being contaminated, by constructing a hooded microwave oven so that air sucked through a base plate thereof cannot enter the electric equipment installation chamber.

It is another object of the present invention to provide a compact ventilation-hooded microwave oven in which width of an electric equipment installation chamber can be minimized by not making an airflow passage going by way of the electric equipment installation chamber disposed on a right side of the ventilation-hooded microwave oven.

According to an aspect of the present invention for achieving the above objects, a hood apparatus of a ventilation-hooded microwave oven, in which a cavity defining a cooking space and an electric equipment installation chamber for accommodating electric equipments to generate microwave required for the cooking are provided within an outer case, comprises an exhaust motor for providing driving force for sucking up contaminated air below the ventilation-hooded microwave oven; a suction portion through which the contaminated air enters the ventilation-hooded microwave oven by means of the suction force of the exhaust motor; and an exhaust airflow passage formed in a space between the cavity and the outer case, so that the air sucked through the suction portion can flow toward the exhaust motor.

The suction portion is formed in a base plate for defining a bottom surface of the outer case.

Further, communication between the suction portion and the electric equipment installation chamber is prevented by a bottom plate for defining a bottom of the electric equipment installation chamber.

The exhaust airflow passage is formed so that the sucked air can flow from a bottom to a top of the ventilation-hooded microwave oven via a gap between the outer case and the cavity opposite to the electric equipment installation chamber.

According to the present invention, contamination of the electric equipments within the electric equipment installation chamber is prevented because the exhaust airflow passage for performing a hood function is formed so as not to pass through the electric equipment installation chamber.

DETAILED DESCRIPTION FOR PREFERRED EMBODIMENT

Figure 1:
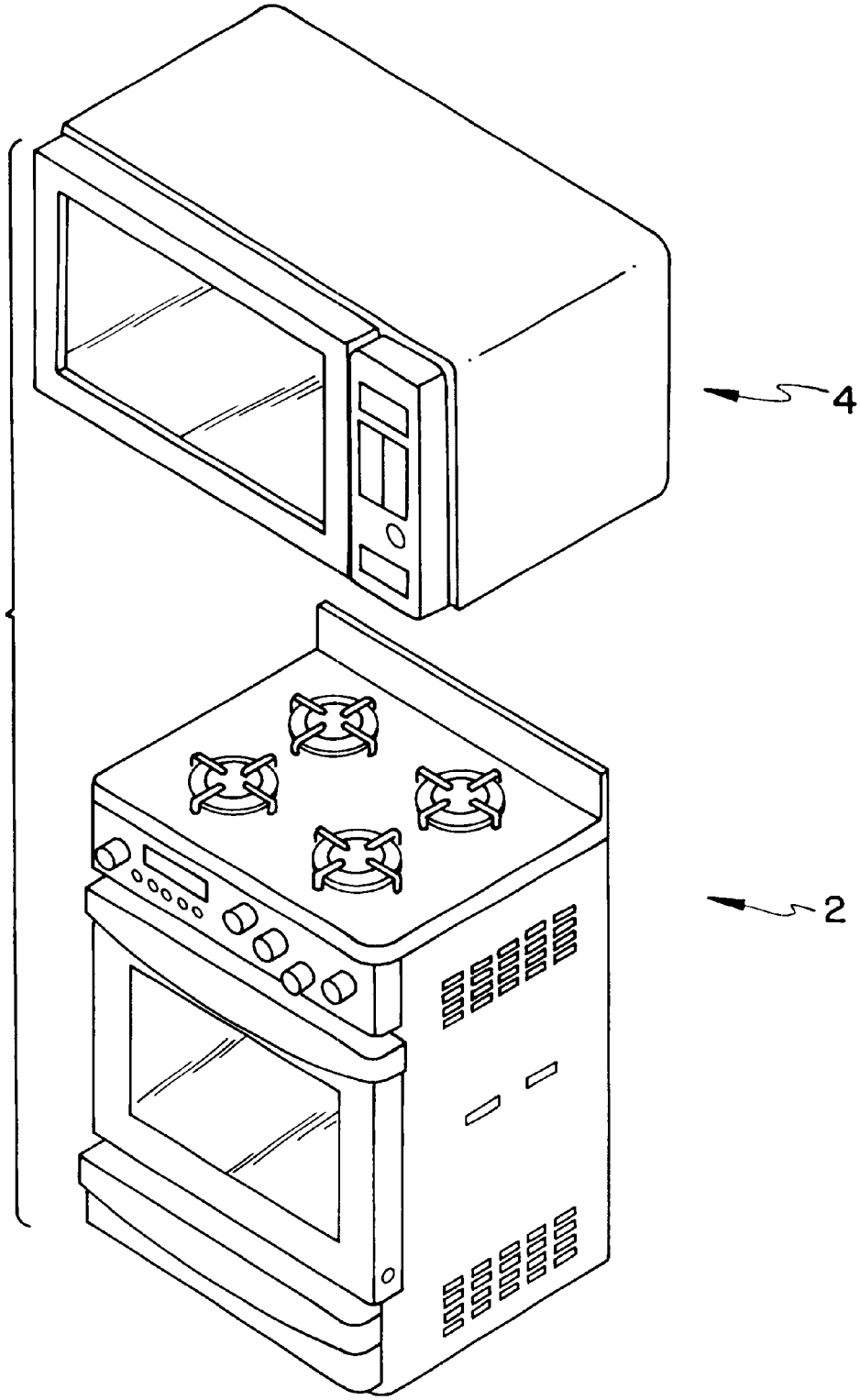
FIG. 1 (PRIOR ART)
FIG. 1 is a perspective view showing external appearances of a ventilation-hooded microwave oven and an oven range.
Figure 2:
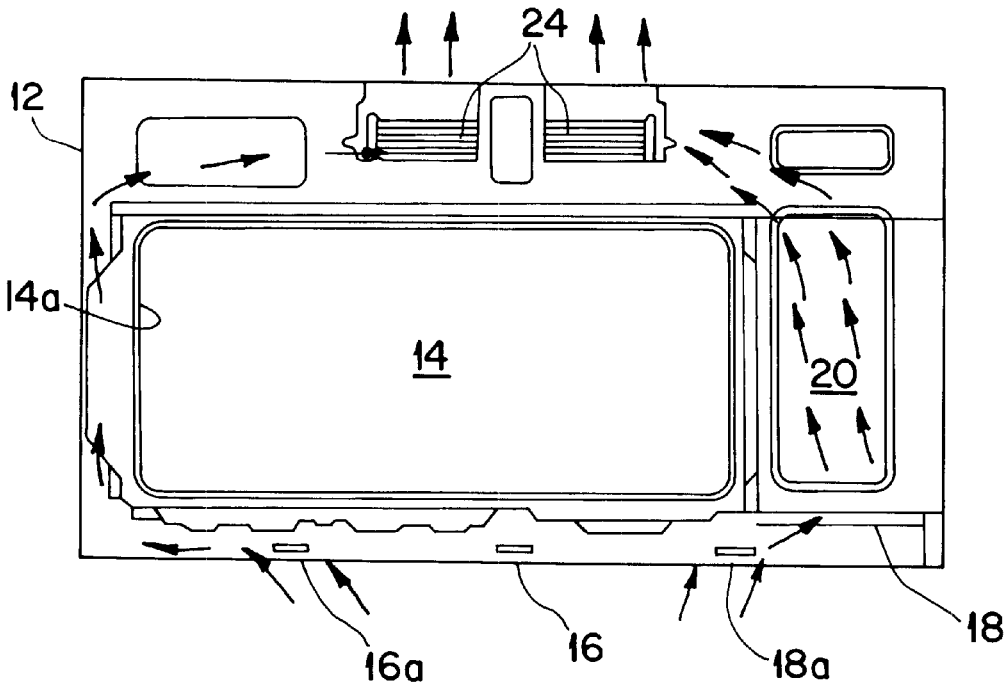
FIG. 2 (PRIOR ART)
FIG. 2 is a front sectional view showing a hood apparatus of a conventional ventilation-hooded microwave oven.
Figure 3:
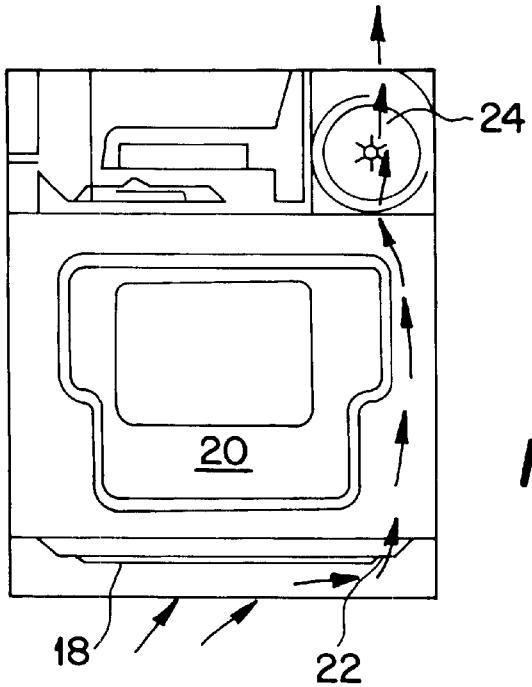
FIG. 3 (PRIOR ART)
FIG. 3 is a right-side sectional view showing the conventional hood apparatus.
Figure 4:
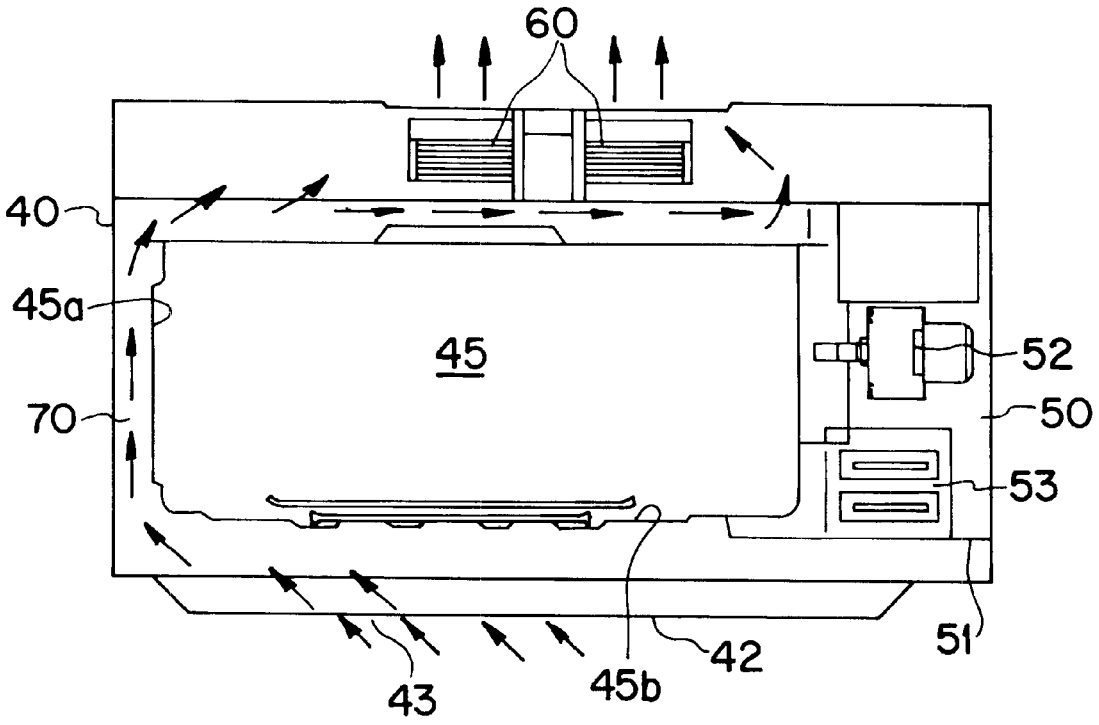
FIG. 4 is a front sectional view showing a hood apparatus of a ventilation-hooded microwave oven according to a preferred embodiment of the present invention.
Figure 5:
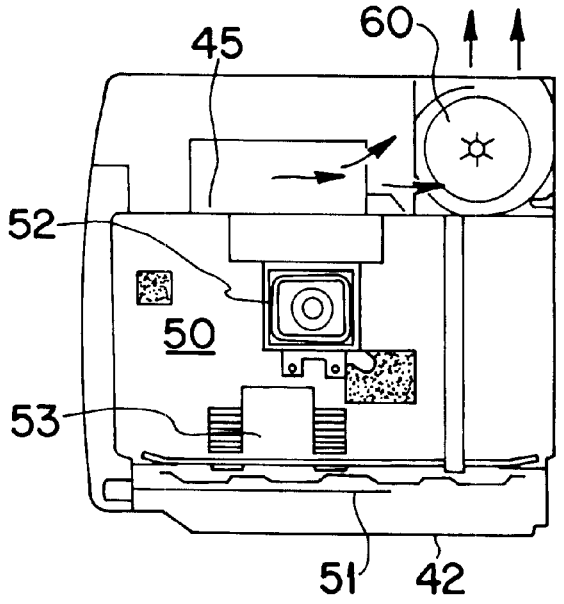
FIG. 5 is a right-side sectional view showing the hood apparatus according to the embodiment of the present invention.

Hereinafter, a hood apparatus of a ventilation-hooded microwave oven according to a preferred embodiment of the present invention will be explained in detail with reference to FIGS. 4 and 5.

As shown in these figures, an external appearance of the ventilation-hooded microwave oven according to the embodiment is defined by an outer case 40. A base plate 42 defines a lower surface of the outer case 40, and a suction portion 43 having a hood function is also formed on the base plate 42. The suction portion 43 is not specifically shown in the figures, but is made in the form of plural small through-holes perforated onto the base plate.

A cavity 45 is provided in the outer case 40. The foodstuffs are cooked within the cavity 45. A predetermined gap or space is formed as an exhaust airflow passage 70 for performing the hood function between the outer case 40 and a left side 45*a* for defining a side of the cavity 45. Further, another gap or space for installing various electric equipments therein and serving as an airflow passage is formed between the base plate 42 and a cavity bottom surface 45*b* for defining a bottom of the cavity 45.

An electric equipment installation chamber 50 is provided beside the cavity 45. A bottom surface of the electric equipment installation chamber 50 is defined by a bottom plate 51, which is made to prevent the electric equipment installation chamber 50 from communicating with a space formed between the base plate 42 and the cavity bottom surface 45*b*.

Electric equipments for generating microwave in order to heat the foodstuffs within the cavity 45 are installed in the electric equipment installation chamber 50. For example, the electric equipments include the magnetron 52, the high-voltage transformer 53, etc.

On the other hand, an exhaust motor 60 is installed on the top of the cavity 45. The exhaust motor 60 is mostly used to perform the hood function, and it sucks up contaminated air through the suction portion 43 and discharges the sucked air outside of the microwave oven. Herein, the air discharged by means of the exhaust motor 60 is transferred to an additional exhaust duct (not shown) and discharged therefrom, or is discharged outside of the microwave oven via an exhaust grille installed in the front or rear of the microwave oven.

Next, an exhaust airflow passage 70 is formed as a path extending from the space between the cavity bottom surface 45*b* and the base plate 42 to the gap between the outer case 40 and the left side 45*a* of the cavity. The air, which is sucked into the microwave oven through the suction portion 43 by means of the suction force of the exhaust motor 60, flows toward the exhaust motor 60 through the exhaust airflow passage 70. Hereinafter, the operation of the hood apparatus according to the present invention will be explained.

When the cooking is performed in the oven range installed below the microwave oven, the contaminated air such as the hot air, the smoke, etc. is generated and the exhaust motor 60 is driven so as to discharge the air.

When the exhaust motor 60 is driven, the contaminated air is introduced into the exhaust airflow passage 70 of the microwave oven via the suction portion 43 formed in the base plate 42. That is, the contaminated air is introduced into the space between the cavity bottom surface 45*b* and the base plate 42, and it then flows upwardly via the gap between the outer case 40 and the left side 45*a* of the cavity by means of the suction force of the exhaust motor 60.

Further, the contaminated air, which flows from the inside of the microwave oven to the top thereof through the exhaust airflow passage 70, is discharged outwardly by means of the exhaust motor 60. In the embodiment, the contaminated air is discharged through an upper portion of the outer case 40. To this end, the upper portion of the outer case 40 should be connected to the additional exhaust duct (not shown).

At this time, since the bottom plate 51 for defining the bottom surface of the electric equipment installation chamber 50 prevents the exhaust airflow passage 70 from communicating with the electric equipment installation chamber 50, the contaminated air sucked through the suction portion 43 of the base plate 42 flows only through the exhaust airflow passage 70 and does not flow through the electric equipment installation chamber 50.

Therefore, the electric equipments such as the magnetron 52, the high-voltage transformer 53, etc. installed within the electric equipment installation chamber 50 are not exposed to the contaminated air sucked by means of the hood function. Furthermore, an additional space for the airflow into the electric equipment installation chamber 50 may not be provided therein.

On the other hand, the number of the electric equipments can be relatively reduced in the present invention, since the exhaust airflow passage 70 is formed by the existing structure without using the additional duct.

Accordingly, the technical subject of the present invention as described above is to construct the airflow passage such that the contaminated air generated from the oven range below the microwave oven cannot pass through the major electric equipments of the microwave oven upon discharge of the air.

According to the present invention constructed as such, the following advantages can be expected.

First, since the airflow passage is formed so that the contaminated air sucked into the microwave oven by means of the hood function does not pass through the inside of the electric equipment installation chamber, the contamination of the electric equipments within the electric equipment installation chamber can be prevented. Therefore, endurance life of the electric equipments can be prolonged and the operation reliability of the microwave oven can be maintained for a long time.

Further, since the airflow by the hood function does not pass through the electric equipment installation chamber, the space required for the hood function does not need to be secured within the electric equipment installation chamber. Therefore, the volume of the electric equipment installation chamber can be relatively reduced and the microwave oven can be miniaturized as a whole.

Accordingly, the foregoing is only one embodiment of the present invention, and the scope of the present invention is not limited to the descriptions as set forth herein. Thus, it is apparent to an ordinary person skilled in the art that various other modifications or changes can be made without departing from the scope and spirit of the invention.

What is claimed is:

1. A hood apparatus of a ventilation hooded microwave oven, in which a cavity defining a cooking space and an electric equipment installation chamber for accommodating electric equipments to generate microwaves for the cooking are provided within an outer case, comprising:

an exhaust motor for providing driving force for sucking up contaminated air below said ventilation-hooded microwave oven;

a suction portion through which said contaminated air enters said ventilation-hooded microwave oven by means of said suction force of said exhaust motor; and an exhaust airflow passage formed in a space between said cavity and said outer case, so that said air sucked through said suction portion can flow toward said exhaust motor, wherein the exhaust airflow passage is formed on a side of said outer case opposite to a side of said outer case containing said electric equipment installation chamber and forms the only exhaust airflow passage for contaminated air within the outer case.

2. The hood apparatus of the ventilation-hooded microwave oven as claimed in claim 1, wherein said suction portion is formed in a base plate defining a bottom surface of said outer case.

3. The hood apparatus of the ventilation-hooded microwave oven as claim in claim 1, wherein communication between said suction portion and said electric equipment installation chamber is prevented by a bottom plate defining a bottom surface of said electric equipment installation chamber.

4. The hood apparatus of the ventilation-hooded microwave oven as claim in claim 1, wherein said exhaust airflow passage is formed so that said sucked air can flow from a bottom to a top of said ventilation-hooded microwave oven via a gap formed between said outer case and said cavity on a side of said microwave oven opposite to a side of said microwave oven containing said electric equipment installation chamber.

5. A microwave oven configured to function as a vent for an oven range, comprising:

an outer case;

a cooking cavity formed within the outer case;

an electric equipment installation chamber formed with the outer case;

an exhaust airflow passage formed within the outer case on a side of said outer case opposite to a side of said outer case containing said electric equipment installation chamber; and an exhaust motor configured to draw contaminated air into the exhaust airflow passage through a suction inlet, wherein the exhaust airflow passage forms the only exhaust airflow passage within the outer case.

6. The microwave oven of claim 5, wherein the suction inlet is formed in a base plate of the outer case.

7. The microwave oven on claim 5, wherein the suction inlet provides the only introduction passage for contaminated air to enter the outer case.

8. The microwave oven of claim 5, wherein the exhaust airflow passage is a delimited channel extending along the side of said outer case opposite to the side of said outer case containing said electric equipment installation chamber.

9. The microwave oven of claim 5, wherein the exhaust airflow passage is formed in a gap between the outer case and the cooking cavity.

10. The microwave oven of claim 5, wherein the exhaust airflow passage is configured so that contaminated air sucked thereinto flows from a bottom to a top of the inner case and then exits the outer case through a vent outlet formed in a top surface of the outer case.

11. The microwave according to claim 10, wherein the vent outlet is positioned adjacent to the exhaust motor.

* * * * *